US006095861A

United States Patent [19]

Lin et al.

[11] Patent Number: 6,095,861

[45] Date of Patent: Aug. 1, 2000

[54] MULTI-RECEPTACLE ELECTRICAL CONNECTOR

[75] Inventors: Cheng Te Lin, Taipei Hsien; Wei-Sun Chang, Peitou Taipei, both of Taiwan

[73] Assignee: Molex Incorporated, Lisle, Ill.

[21] Appl. No.: 09/039,956

[22] Filed: Mar. 16, 1998

[30] Foreign Application Priority Data

Aug. 13, 1997 [CN] China ..... 86213809

[51] Int. Cl.[7] ..... H01R 13/648

[52] U.S. Cl. ..... 439/607; 439/541.5

[58] Field of Search ..... 439/607, 608, 439/609, 610, 108, 541.5, 680, 677, 852

[56] References Cited

U.S. PATENT DOCUMENTS

| | | | |
|---|---|---|---|
| 5,037,330 | 8/1991 | Fulponi et al. | 439/607 |
| 5,156,554 | 10/1992 | Rudoy et al. | 439/108 |
| 5,221,212 | 6/1993 | Davis | 439/108 |
| 5,362,249 | 11/1994 | Carter | 439/357 |
| 5,401,192 | 3/1995 | Briones et al. | 439/639 |
| 5,637,015 | 6/1997 | Tan et al. | 439/607 |
| 5,735,699 | 4/1998 | Tan et al. | 439/92 |
| 5,899,773 | 5/1999 | Cheng | 439/651 |

FOREIGN PATENT DOCUMENTS

| | | | |
|---|---|---|---|
| 29602268 U1 | 11/1996 | Germany . | |
| 4-269480 | 11/1990 | Japan | H01R 13/648 |
| 5-217632 | 4/1992 | Japan | H01R 13/648 |
| 9-134750 | 7/1995 | Japan | H01R 13/95 |
| 3-32378 | 1/1999 | Japan | H01R 13/648 |
| 321371 | 11/1997 | Taiwan | H01R 13/648 |

*Primary Examiner*—Paula Bradley
*Assistant Examiner*—Alexander Gilman
*Attorney, Agent, or Firm*—Charles S. Cohen

[57] ABSTRACT

An electrical connector includes a dielectric housing having differently configured receptacles and differently configured terminal supports projecting forwardly in the receptacles. A conductive shell surrounds a substantial portion of the housing and includes openings in registry with the receptacles. The shell has different arrays of grounding spring fingers projecting into the receptacles from edges of the openings. A plurality of terminals are mounted on the housing, with contact portions in different arrays on selective sides of the terminal supports.

19 Claims, 4 Drawing Sheets

MULTI-RECEPTACLE ELECTRICAL CONNECTOR

FIELD OF THE INVENTION

This invention generally relates to the art of electrical connectors and, particularly, to a connector which has a plurality of receptacles of different configurations for receiving differently configured electrical plugs.

BACKGROUND OF THE INVENTION

In computer design, a computer mainboard mounts different interface cards for different computer peripheral apparatuses, and different connectors must be provided for connecting the different peripheral apparatus to different interface cards on the computer mainboard. There are known connectors providing specified functions. Because these connectors are independent components, they occupy considerable space on the computer mainboard. When installed, they must be separately soldered to the mainboard. Furthermore, separate assembly procedures as well as separate dismounting procedures are required for each connector.

There is a need to provide a single connector receptacle assembly which is capable of receiving multiple connectors of different configurations and different functions and solving the duplicity problems discussed above. The present invention is directed to satisfying this need and solving those problems.

SUMMARY OF THE INVENTION

An object, therefore, of the invention is to provide a new and improved multi-receptacle electrical connector of the character described.

In the exemplary embodiment of the invention, the electrical connector includes a dielectric housing having at least first and second receptacles for receiving appropriate complementary first and second mating connectors. A first terminal support projects forwardly in a mating direction within the first receptacle. A second terminal support projects forwardly in a mating direction within the second receptacle. A conductive shell substantially surrounds the dielectric housing and includes first and second openings in registry with the first and second receptacles, respectively, for insertion therethrough of the mating connectors.

The invention contemplates that the shell include a pair of first grounding spring fingers projecting into the first receptacle from opposite edges of the first opening for engaging an appropriate shell of the first mating connector. At least one second grounding spring finger projects into the second receptacle from an edge of the second opening for engaging an appropriate shell of the second mating connector. The second grounding spring finger is pre-loaded with a distal end of the finger seated behind a ledge of the housing within the second receptacle. A plurality of terminals are mounted on the housing, with some of the terminals having contact portions on opposite sides of the first terminal support. Other of the terminals have contact portions on only one side of the second terminal support.

As disclosed herein, the first terminal support includes opposite sides and opposite ends, with contact portions of some of the terminals on both opposite sides. The pair of first grounding spring fingers are located near both opposite ends of the first terminal support. The second grounding spring finger is located near one side of the second terminal support, with the contact portions of the other of the terminals being on an opposite side of the second terminal support. Preferably, a pair of the second grounding spring fingers are located near the one side of the second terminal support. Each of the second grounding spring fingers includes angled portions defining an apex directed inwardly toward the second terminal support.

The electrical connector is disclosed herein for mounting on a printed circuit board. The plurality of terminals have tail portions for connection to circuit traces on the printed circuit board. The conductive shell has leg portions for insertion into holes in the circuit board.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
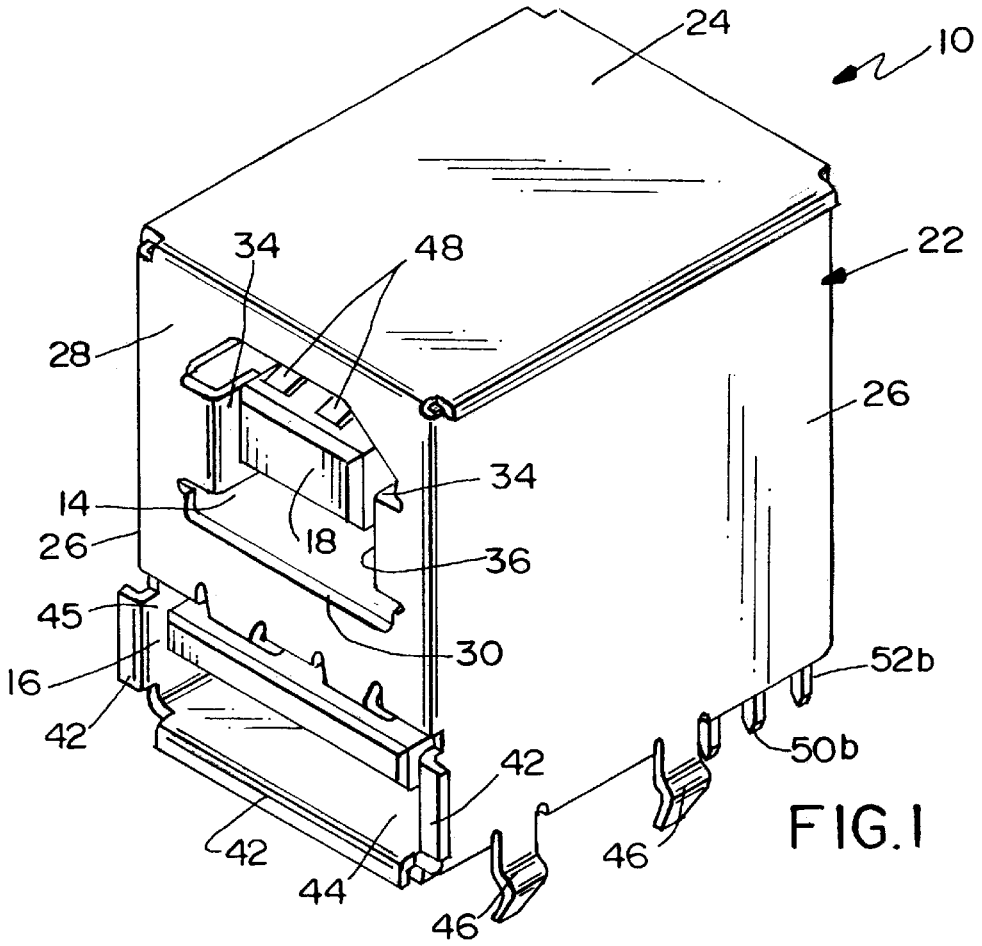
FIG. 1 is a perspective view of one embodiment of an electrical connector incorporating the concepts of the invention.
Figure 2:
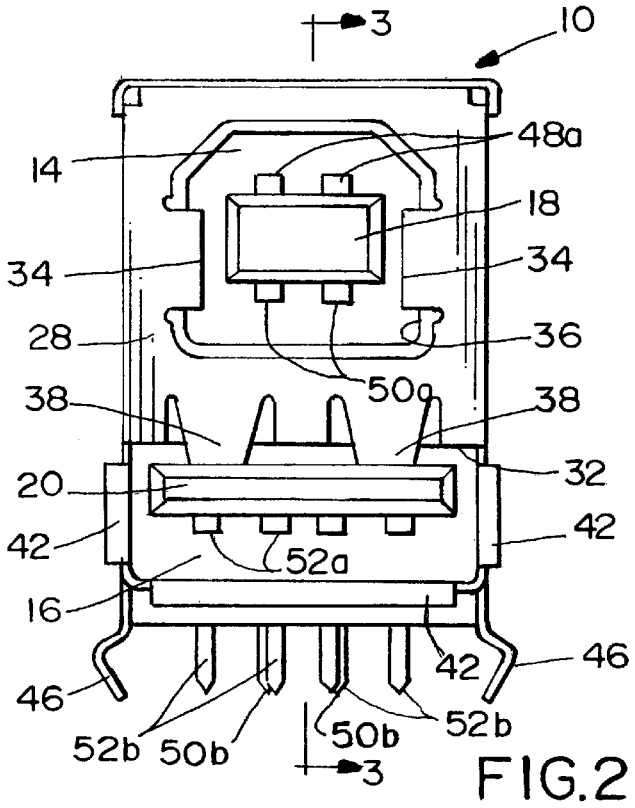
FIG. 2 is a front elevational view of the connector of FIG. 1.
Figure 3:
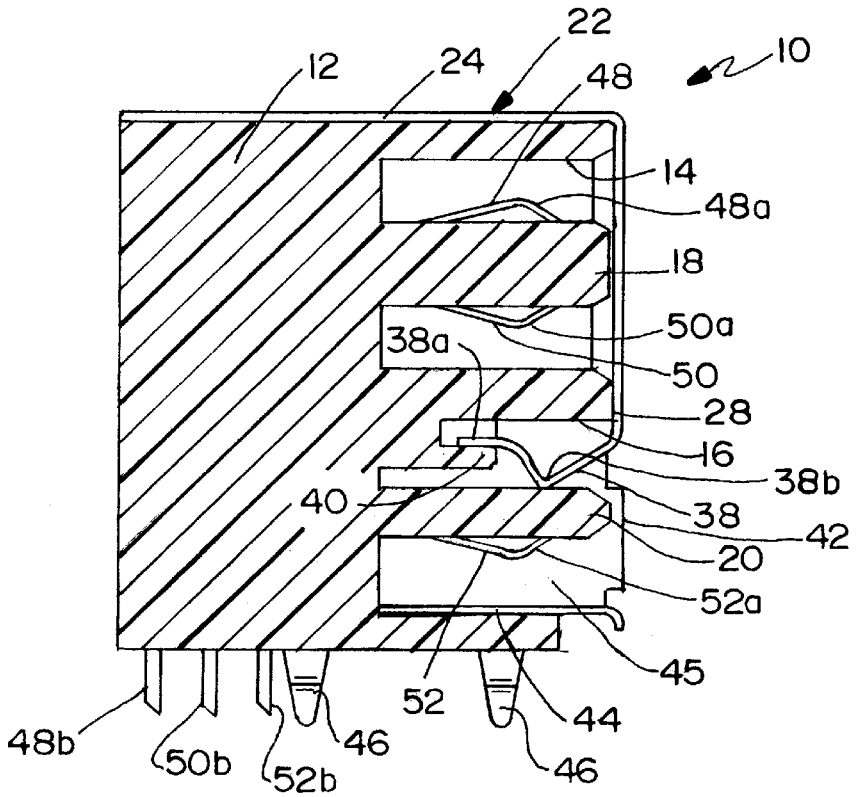
FIG. 3 is a vertical section taken generally along line 3—3 of FIG. 2.

Referring to the drawings in greater detail, and first to FIGS. 1–3, a first embodiment of an electrical connector, generally designated 10, includes a dielectric housing 12 (FIG. 3) having first and second receptacles 14 and 16, respectively, for receiving appropriate complementary first and second mating connectors (not shown). The housing includes a first terminal support 18 projecting forwardly in a mating direction generally centrally within first receptacle 14. As can be seen in FIGS. 2 and 3, terminal support 18 is elongated to define opposite sides and opposite ends. A second terminal support 20 projects forwardly in a mating direction generally centrally within second receptacle 16. Like terminal support 18, terminal support 20 is elongated to define opposite sides and opposite ends.

Electrical connector 10 includes a generally box-shaped conductive shell, generally designated 22, which substantially surrounds dielectric housing 12. The shell may be stamped and formed of sheet metal material and include a top wall 24, opposite side walls 26 and a front wall 28. The shell includes first and second openings 30 and 32, respectively, in registry with first and second receptacles 14 and 16, respectively, of housing 12 for insertion therethrough of the mating connectors. The lateral edges of the first opening 30 are parallel to each other and orthogonal to the lower edge. Three upper edges of the first opening are angularly disposed to comprise half of a hexagon. The shell includes a pair of first grounding spring fingers 34 projecting from front wall 28 into first receptacle 14 from opposite edges 36 of first opening 30 for engaging an appropriate shell of the first mating connector. As best seen in FIG. 2, a pair of second grounding fingers 38 project from front wall 28 of the shell at a top edge of second opening 32 and into second receptacle 16 for engaging an appropriate shell of the second mating connector. Each second grounding spring finger 38 has an inner distal end 38*a* seated behind a ledge 40 of the housing within second receptacle 16 for pre-loading the spring fingers. Each second grounding spring finger 38 also has angled portions defining an apex 38*b* facing downwardly or inwardly toward second terminal support 20 of the housing. Three flanges 42 are flared outwardly from the three edges of opening 32 remote from the edge from which second grounding spring fingers 38 project.

As best seen in FIG. 3, the shell has a substantial bottom plate 44 and side plates 45 (FIG. 1) which project inwardly into second receptacle 16 of the housing to define the transverse bottom wall and parallel side walls of the receptacle. Finally, the shell includes a plurality of leg portions 46 for insertion into appropriate holes in a printed circuit board to solder-connect the shell to grounding traces on the board and/or in the holes. It can be seen that the legs are offset and angled to provide a press-fit in the board holes to facilitate holding the connector to the board during a soldering process.

Generally, a plurality of terminals 48, 50, 52 are mounted on housing 12 and include respective tail portions 48*b*, 50*b*, 52*b*, for insertion into appropriate holes in the printed circuit board to solder-connect the terminals to circuit traces on the board and/or in the holes. The terminals 48, 50 in the first receptacle 14 have contact portions 48*a*, 50*a* supported in grooves on both opposite sides of first terminal support 18 within first receptacle 14 of the housing. First grounding spring fingers 34 are located near both opposite ends of the terminal support 18.

The terminals 52 have contact portions 52*a* supported in grooves located on only one side of second terminal support 20 within second receptacle 16 of the housing. It can be seen that second grounding spring fingers 38 are located at one side of the terminal support and contact portions 52*a* are located at an opposite side of the terminal support.

Figure 4:
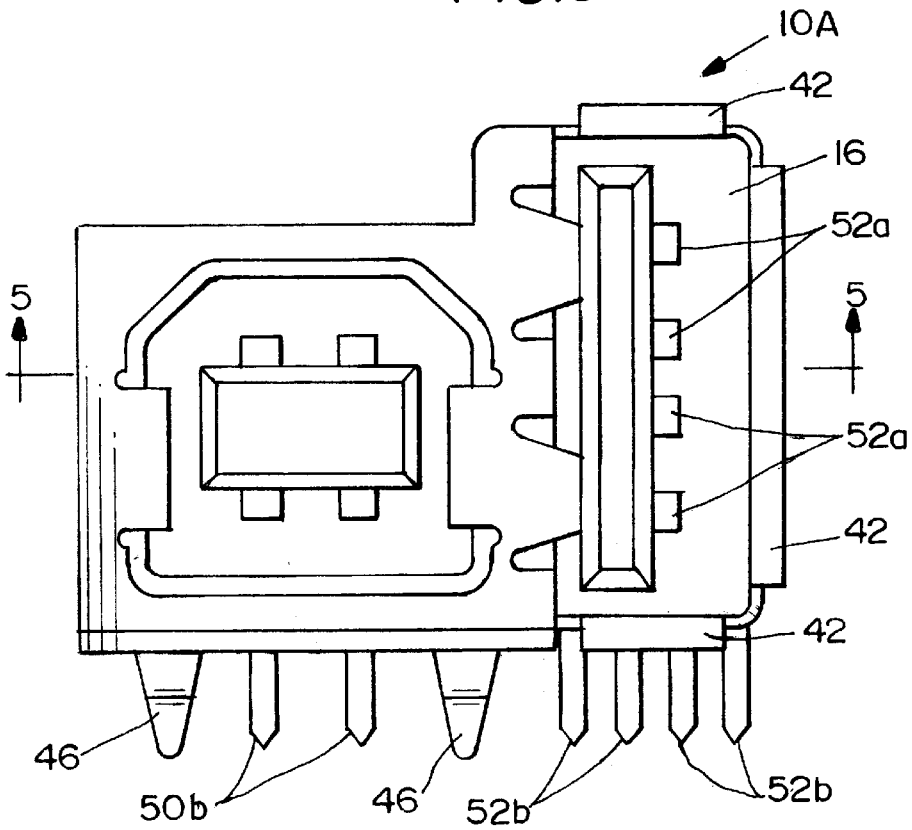
FIG. 4 is a front elevational view of a second embodiment of an electrical connector according to the invention.
Figure 5:
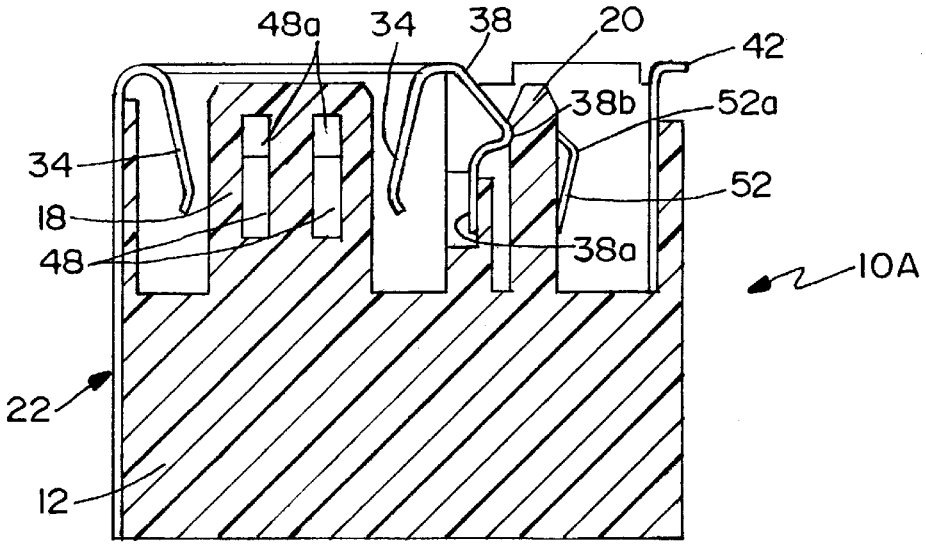
FIG. 5 is a horizontal section taken generally along line 5—5 of FIG. 4.

FIGS. 4 and 5 show a second embodiment of an electrical connector, generally designated 10A, according to the invention. It can be seen that the basic configurations of the two receptacles 14 and 16, as well as the associated shell portions and contact portions have the same configurations as shown in the embodiment of FIGS. 1–3 and described above. Consequently, like reference numerals have been applied in FIGS. 4 and 5 corresponding to like components described above in relation to FIGS. 1–3.

The difference between connector 10A (FIGS. 4 and 5) and connector 10 (FIGS. 1–3) is that receptacles 14 and 16 have been reoriented in FIGS. 4 and 5 so that elongated terminal supports 18 and 20 extend generally in relative perpendicular directions versus the parallel directions of connector 10 in FIGS. 1–3. The terminals 48, 50, 52 are configured so that tail portions 48*b* and 50*b* do not laterally overlap with tail portions 52*b*. Tail portions 52*b* now project from a side of receptacle 16 of connector 10A in comparison to the bottom of receptacle 16 of connector 10. Leg portions 46 of the shell also have been relocated.

Figure 6:
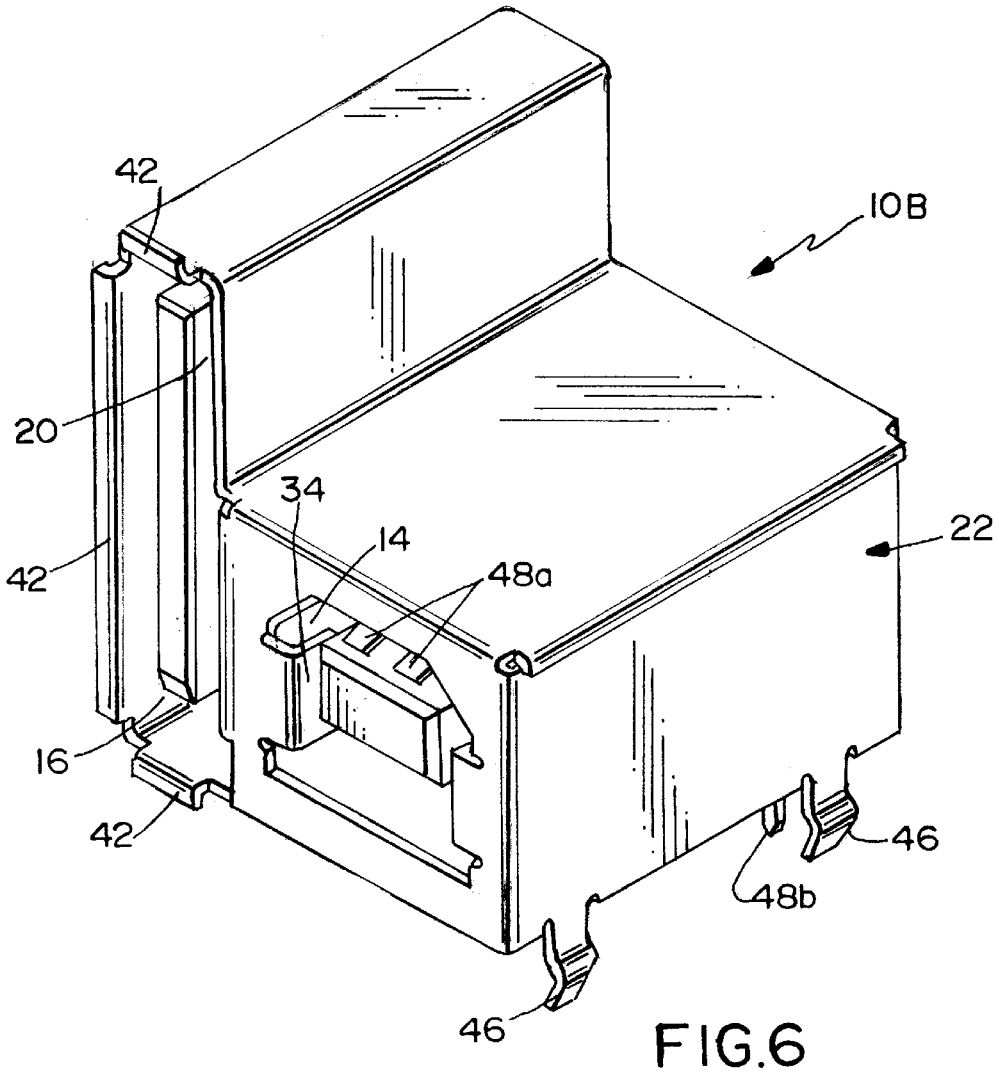
FIG. 6 is a perspective view of a third embodiment of an electrical connector according to the invention.

FIG. 6 shows a third embodiment of an electrical connector, generally designated 10B, according to the invention. Again, like reference numerals are applied in FIG. 6 corresponding to like components described above in relation to the embodiments of FIGS. 1–5. Connector 10B in FIG. 6 has a configuration substantially identical to that of connector 10A (FIGS. 4 and 5), except that receptacle 16 has been located in connector 10B to the left of receptacle 14, versus receptacle 16 of connector 10A being located at the right of receptacle 14.

Figure 7:
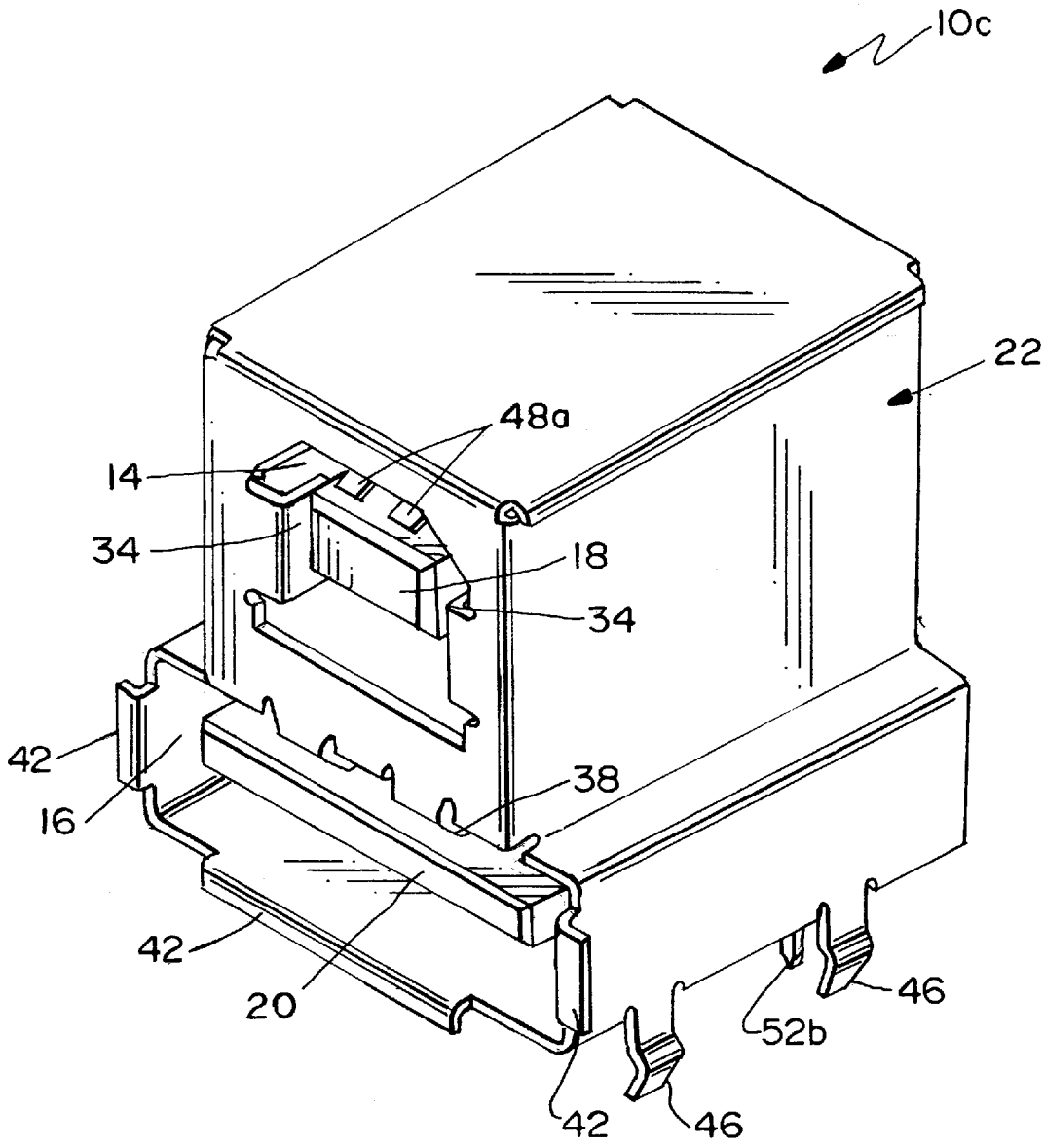
FIG. 7 is a perspective view of a fourth embodiment of an electrical connector according to the invention.

FIG. 7 shows a fourth embodiment of an electrical connector, generally designated 10C. Again, like reference numerals have been applied in FIG. 7 corresponding to like components described above in relation to the embodiments of FIGS. 1–6. Connector 10C is substantially identical to connector 10 (FIGS. 1–3) except that receptacle 16 of connector 10C is wider than receptacle 16 of connector 10. The enlarged receptacle 16 in connector 10C is provided for accommodating an enlarged or elongated second mating connector.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector, comprising:

a dielectric housing having at least first and second receptacles for receiving appropriate complementary first and second mating connectors, a first terminal support projecting forwardly in a mating direction within the first receptacle, and a second terminal support projecting forwardly in mating direction within the second receptacle;

a conductive shell substantially surrounding the dielectric housing and including first and second openings in registry with the first and second receptacles, respectively, for insertion therethrough of the mating connectors, the shell including a pair of first grounding spring fingers projecting into the first receptacle from opposite edges of said first opening for engaging an appropriate shell of the first mating connector, and at least one second grounding spring finger projecting into the second receptacle from an edge of said second opening for engaging an appropriate shell of the second mating connector, the second grounding spring finger being pre-loaded with a distal end of the finger seated in engagement with a ledge of the housing, said ledge being spaced apart from both of said first terminal support and said second terminal support; and a plurality of terminals mounted on the housing, some of the terminals having contact portions on opposite sides of the first terminal support, and other of the terminals having contact portions on only one side of the second terminal support.

2. The electrical connector of claim 1 wherein said first terminal support includes opposite sides and opposite ends, said some of the terminals having contact portions on both opposite sides and said pair of first grounding spring fingers being located near both opposite ends of the first terminal support.

3. The electrical connector of claim 1 wherein said plurality of terminals have tail portions for connection to circuit traces of an appropriate printed circuit board.

4. The electrical connector of claim 1 wherein said conductive shell includes flanges flared outwardly from edges of the second opening remote from said edge from which the second grounding spring finger projects.

5. The electrical connector of claim 1 wherein said second grounding spring finger includes angled portions defining an apex directed inwardly toward the second terminal support.

6. The electrical connector of claim 1 wherein said second grounding spring finger is located near one side of the second terminal support and said other of the terminals have contact portions on an opposite side of the second terminal support.

7. The electrical connector of claim 3, including a pair of said second grounding spring fingers located near said one side of the second terminal support.

8. The electrical connector of claim 1 wherein said conductive shell has leg portions for insertion into holes in an appropriate printed circuit board.

9. The electrical connector of claim 8 wherein said plurality of terminals have tail portions for connection to circuit traces of an appropriate printed circuit board.

10. An electrical connector, comprising:

a dielectric housing having at least first and second terminal supports spaced from each other and projecting forwardly in a mating direction;

a conductive shell about a substantial portion of the dielectric housing and including first and second dissimilarly shaped openings in registry with the first and second terminal supports, respectively, for insertion therethrough of appropriate complementary first and second mating connectors, said first opening including three upper edges and a lower edge, a middle upper edge disposed parallel to said lower edge and two side upper edges acutely angularly disposed with respect to the lower edge, the shell including a pair of first grounding spring fingers projecting inwardly from opposite edges of said first opening for engaging an appropriate shell of the first mating connector, and and a pair of second grounding spring fingers projecting inwardly from an edge of said second opening near one side of the second terminal support for engaging an appropriate shell of the second mating connector; and a plurality of terminals mounted on the housing, some of the terminals having contact portions on opposite sides of the first terminal support, and other of the terminals having contact portions on only said one side of the second terminal support.

11. The electrical connector of claim 10 wherein said first terminal support includes opposite sides and opposite ends, said some of the terminals having contact portions on both opposite sides and said pair of first grounding spring fingers being located near both opposite ends of the first terminal support.

12. The electrical connector of claim 10 wherein said second grounding spring finger is located near one side of the second terminal support and said other of the terminals have contact portions on an opposite side of the second terminal support.

13. The electrical connector of claim 10 wherein said plurality of terminals have tail portions for connection to circuit traces of an appropriate printed circuit board.

14. The electrical connector of claim 10 wherein said conductive shell includes flanges flared outwardly from edges of the second opening remote from said edge from which the second grounding spring finger projects.

15. The electrical connector of claim 10 wherein said second grounding spring finger includes angled portions defining an apex directed inwardly toward the second terminal support.

16. The electrical connector of claim 10 wherein said conductive shell has leg portions for insertion into holes in an appropriate printed circuit board.

17. The electrical connector of claim 16 wherein said plurality of terminals have tail portions for connection to circuit traces of an appropriate printed circuit board.

18. An electrical connector, comprising:

a dielectric housing having a first terminal support projecting forwardly in a mating direction, the first terminal support being elongated in cross-section defining opposite sides and opposite ends, a second terminal support projecting forwardly in said mating direction, and the second terminal support being elongated in cross-section defining opposite sides and opposite ends;

a plurality of terminals mounted on the housing, some of the terminals having contact portions on said opposite sides of the first terminal support, and other of the terminals having contact portions on only one side of the second terminal support; and a conductive shell about a substantial portion of the dielectric housing and including first and second openings in registry with the first and second terminal supports, respectively, the shell including a first grounding finger projecting inwardly near the first terminal support from an edge of said first opening, and a second grounding finger projecting inwardly near the second terminal support from an edge of said second opening, said second grounding finger being located on the other side of the second terminal support opposite the contact portions of said other of the terminals.

19. The electrical connector of claim 18, including a pair of said first grounding fingers located near said opposite ends of the first terminal support.

* * * * *